US005354973A

United States Patent [19]

Beckett

[11] Patent Number: 5,354,973

[45] Date of Patent: Oct. 11, 1994

[54] MICROWAVE HEATING STRUCTURE COMPRISING AN ARRAY OF SHAPED ELEMENTS

[75] Inventor: D. Gregory Beckett, Oakville, Canada

[73] Assignee: Beckett Industries Inc., Oakville, Canada

[21] Appl. No.: 10,803

[22] Filed: Jan. 29, 1993

[30] Foreign Application Priority Data

Jan. 29, 1992 [GB] United Kingdom ..... 9201932

[51] Int. Cl.[5] ..... H05B 6/80

[52] U.S. Cl. ..... 219/730; 219/728; 426/234; 426/107; 99/DIG. 14

[58] Field of Search ..... 219/10.55 E, 10.55 F, 219/728, 729, 730, 759; 426/107, 109, 111, 234, 241, 243; 99/DIG. 14

[56] References Cited

U.S. PATENT DOCUMENTS

| | | | |
|---|---|---|---|
| 3,219,460 | 11/1965 | Brown | 219/10.55 E |
| 3,490,580 | 1/1970 | Brumfield et al. | 219/10.55 E |
| 3,845,266 | 10/1974 | Derby | 219/10.55 F |
| 4,230,924 | 10/1980 | Brastad et al. | 219/10.55 |
| 4,398,994 | 8/1983 | Beckett | 156/659.1 |
| 4,552,614 | 11/1985 | Beckett | 156/640 |
| 4,641,005 | 2/1987 | Seiferth | 219/10.55 |
| 5,117,078 | 5/1992 | Beckett | 219/10.55 E |
| 5,171,594 | 12/1992 | Babbit | 219/10.55 E |
| 5,185,506 | 2/1993 | Walters | 219/10.55 E |

FOREIGN PATENT DOCUMENTS

| | | | |
|---|---|---|---|
| WO91/11893 | 8/1991 | PCT Int'l Appl. | 219/728 |

*Primary Examiner*—Philip H. Leung
*Attorney, Agent, or Firm*—Sim & McBurney

[57] ABSTRACT

A novel structure for use in the microwave cooking of foodstuffs for consumption is described. The structure includes an array of individual shapes of flexible electroconductive material normally opaque to microwave radiation supported on a microwave transparent substrate. Each of the individual discrete shapes of flexible electroconductive material has a thickness normally opaque to microwave radiation and is formed in an H-, I- or elongate strip shape. The individual discrete shapes are arranged on the substrate to define a space surrounding the periphery of each individual shape with the spaces defining a continuous aperture extending throughout the array and effective to generate thermal energy in the continuous aperture when the article is exposed to microwave energy and the foodstuff is in contact with or proximate to the aperture. The multiple layer article of manufacture is adapted to be formed into a packaging structure in which a foodstuff may be heated by microwave energy to an edible condition.

20 Claims, 1 Drawing Sheet

MICROWAVE HEATING STRUCTURE COMPRISING AN ARRAY OF SHAPED ELEMENTS

FIELD OF INVENTION

The present invention relates to a novel structure for effecting heating of foodstuffs by microwave energy.

BACKGROUND TO THE INVENTION

The use of microwave energy to cook a variety of foodstuffs to an edible condition is quick and convenient. However, some foodstuffs require crispening or browning to be acceptable for consumption, which is not possible with conventional microwave cooking.

It is known from U.S. Pat. No. 4,641,005 (Seiferth), assigned to James River Corporation, that it is possible to generate thermal energy from a thin metallic film (microwave susceptor) upon exposure thereof to microwave radiation and this effect has been used in a variety of packaging structures to achieve cooking of foodstuffs with microwave energy, including achieving crispening and browning, for example, of pizza crust.

It also has previously been suggested from U.S. Pat. No. 4,230,924 (Brastad et al) to provide microwave energy generated browning of a foodstuff from a food package which includes a flexible wrapping sheet of polymeric film having a flexible metal coating, which either may be relatively thin film or relatively thick foil and which, in either case, is subdivided into a plurality of individual metallic islands in the form of squares.

SUMMARY OF INVENTION

In accordance with the present invention, there are provided novel arrangements which provide a more efficient usage of normally microwave-opaque metal than achieved by Brastad et al, while achieving a uniformity of thermal energy generation from incident microwave radiation which is comparable to that achieved by Seiferth.

This result is achieved herein by providing an array of interfitted elements of microwave-opaque electroconductive material, each having an I- or H-outline shape. By interfitting elements of this outline shape, the surface area occupied by thermal energy producing elements is minimized and a uniform thermal energy generation is achieved across the surface of the structure.

In an alternative embodiment of the invention, thermal energy generation is effected from an array of closely spaced apart elongate strips of microwave opaque electroconductive material. In either case, the elements and strips of microwave opaque electroconductive material are supported on a suitable substrate, such as a heat-resistant polymeric film.

Accordingly, in the present invention, there is provided a multiple layer article of manufacture adapted to be formed into a packaging structure in which a foodstuff may be heated by microwave energy to an edible condition. By providing an article of manufacture which is able to be formed into a packaging structure, in accordance with the present invention, a food product may be maintained in the same structure through the multiple steps of filling, freezing, storing, shipping, retailing and then microwave reconstitution for consumption, before discharge.

The article comprises a plurality of individual discrete shapes of flexible electroconductive material supported in an array on a substrate layer. Each individual discrete shape of flexible electroconductive material has a thickness which is normally opaque to microwave radiation and is formed in an H- or I-outline or elongate-strip shape. The individual shapes are arranged on the substrate to define a space surrounding the periphery of each individual shape. The spaces surrounding the plurality of shape define a continuous aperture extending throughout the array of discrete shapes. The array and continuous aperture are effective to generate thermal energy in the continuous aperture when the article is exposed to microwave energy and the foodstuff is in contact with or proximate to the aperture.

The substrate layer is formed of microwave energy transparent material and is in adhesive structural relationship with the plurality of individual discrete shapes of flexible electroconductive material so that a packaging structure may be formed from the article in which the foodstuff may be positioned.

DESCRIPTION OF PREFERRED EMBODIMENT

Figure 1:
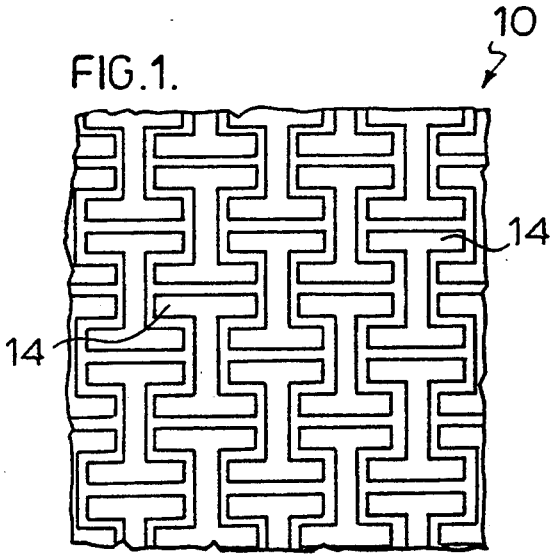
FIG. 1 is a plan view of a microwave heating element provided in accordance with one embodiment of the invention.
Figure 2:
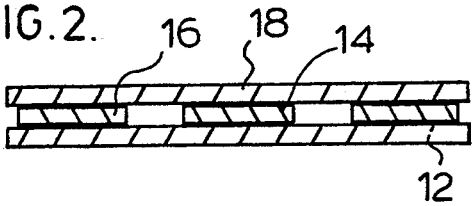
FIG. 2 is a cross-sectional view of the heating element of FIG. 1.

As may be seen in FIGS. 1 and 2, a microwave heating structure 10, which may be incorporated into a variety of foodstuff heating devices comprises a substrate layer 12, a plurality of discrete interfitted elements 14 each having a I- outline shape supported on the substrate layer 16 and, optionally, overlaid by a further layer 18 of any convenient form, as described below.

Each of the elements 14 preferably has the same outline shape and has the same peripheral dimensions. However, variations may be made both in terms of relative dimensions and shapes to provide differential degrees of heating within the same heating structure 10.

Figure 1A:
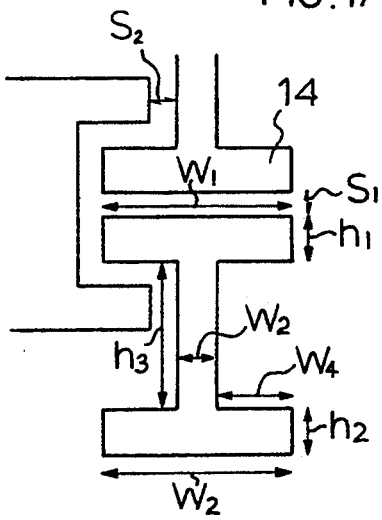
FIG. 1A is a close-up view of the microwave heating element of FIG. 1.

Referring to FIG. 1A, with a uniform arrangement, $W_1=W_2$ and $3\times W_3=W_1$ and similarly $h_1=h_2$. To permit the adjacent abutted arms of the elements 14 to be spaced from each other by S1 and to permit the arms of the elements 14 to be spaced by $S_2$, then $h_3=W_1+W_2+2\times S_1$. However, for particular heating effects, a non-uniform array may be provided. The various dimensions may vary widely from about 1/64 to about 7 inches.

Figure 3:
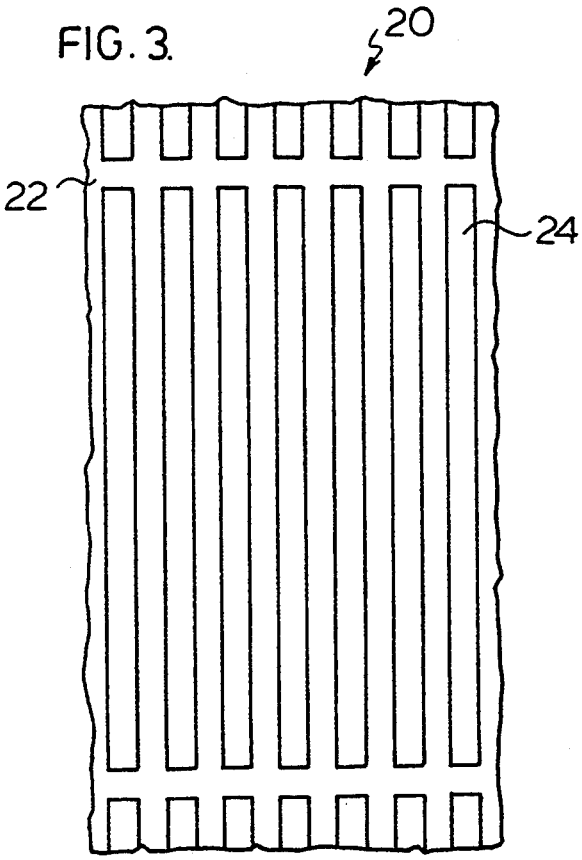
FIG. 3 is a plan view of a microwave heating element provided in accordance with an alternative embodiment of the invention.
Figure 3A:
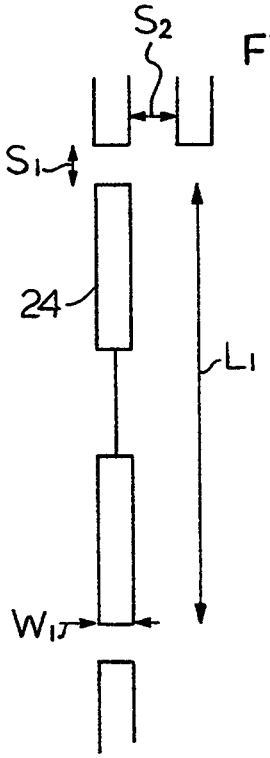
FIG. 3A is a close-up view of the microwave heating element of FIG. 3.

FIG. 3 illustrates an alternative microwave heating structure 20, which comprises a substrate layer 22 bearing an array of elongate strips 24 of electroconductive material. The array of elongate strips 24 may be overlaid by a further layer of any convenient form, as described below.

Each of the elongate strips 24 has the same width and is spaced from each longitudinally-adjacent and laterally-adjacent strip 24 by the same distance.

However, to achieve particular heating effects, the various parameters may be varied for one, some or a combination of strips 24. The length $l_1$ of the strips 24 generally varies from about 1/64 to about 7 inches, the width $W_1$ may vary from about 1/64 to about 7 inches, the strips 24 may be longitudinally spaced apart $S_1$ from about 1/64 to about 7 inches and may be laterally spaced apart $S_2$ from about 1/64 to about 7 inches.

When the array of elements 14 or 24 is exposed to microwave radiation and the structure 10 or 20 is adjacent to a foodstuff, thermal energy is generated in each gap between an adjacent electroconductive body, so that, as compared to the Brastad et al island structure, the surface area of metal required to achieve the same thermal energy generation is minimized. The thermal energy generation in the continuous aperture defined by the gaps causes surface browning of the food. In addition, since the various gaps are closely spaced one from another and yet permit microwave energy to pass through the gaps into the foodstuff being heated, the overall uniformity of thermal energy generation is improved as compared to the Brastad et al structure and approximates that of Seiferth.

Each of the discrets elements 14 and 24 is formed of flexible electroconductive material which is of a thickness normally opaque to microwave energy and which is adhered to and supported by a layer 12, 22 of microwave transparent material. The minimum thickness varies with the material chosen. Generally, the layer has a minimum thickness of about 1 micron. The flexible electroconductive material conveniently may be provided by aluminum foil having a thickness of about 1 to about 15 microns, preferably about 3 to about 10 microns, typically about 7 to about 8 microns. Other suitable electroconductive materials include stainless steel, copper and carbon.

An alternative which may be employed, depending on the result which is desired, is to provide a layer of electroconductive material adhered to the substrate layer, which is of sufficient thinness that a portion of microwave energy incident thereon is converted to thermal energy, as described by Seiferth, so as to augment the browning effect achieved by the continuous aperture.

The array of elements 14 or 24 may be provided in any convenient manner, consistent with the materials employed. Preferably, with the electroconductive material being aluminum foil or other etchable metal supported on a polymeric film, such as by laminating adhesive, the array may be formed by selective demetallization of metal from the polymeric film using, for example, the procedures described in U.S. Pat. Nos. 4,398,994 and 4,552,614 and copending U.S. patent application Ser. No. 828,496 filed Jan. 31, 1992 ("DEMET V"), all assigned to the assignee hereof and the disclosures of which are incorporated herein by reference, wherein an aqueous etchant is employed to remove aluminum from areas unprotected by a pattern of etchant resistant material corresponding to the array. Another possible procedure involves the use of ultrasonic sound to effect such selective demetallization.

Following such selective demetallization, a polymeric lacquer or other detackifying material may be applied over the exposed surfaces of laminating adhesive in the selectively demetallized electroconductive layer to inhibit adjacent layers from adhering to one another as a result of exposed adhesive in the apertures, when a web of such selectively demetallized material is rolled up, as is often the case prior to formation of the desired packaging material.

For the purpose of providing a packaging material, the array of flexible electroconductive material is supported on and adhered to the continuous substrate 18 of suitable microwave-transparent substrate which generally is a microwave-transparent stock material which does not deform upon the generation of heat from the layer of electroconductive material during exposure of a foodstuff in the packaging material to microwave energy.

The array of flexible electroconductive material may conveniently be laminated to a paper or paperboard substrate as the stock material, which may be semi-stiff or stiff, with the packaging material being formed from the resulting laminate. Similarly, the array of flexible electroconductive material may be laminated to a heat-resistant polymeric substrate as the stock material to provide the article of manufacture. The array of flexible electroconductive material also may be laminated between two outer paper or paperboard layers, or may be laminated between a heat-resistant polymeric material layer, and a paper or paperboard layer. In these structures, the polymeric material layer, such as polyester or polyethylene, may be flexible or rigid.

Alternatively, the array of electroconductive material may be provided laminated to a single or between two rigid thermoformable polymeric material layer(s), by adhesive bonding, and the laminate may be thermoformed to the desired product shape.

The multiple layer article of manufacture of the present invention may be incorporated into a variety of packaging structures for housing foodstuffs where the generation of thermal energy during microwave heating is desired. The structures may include a variety of trays and dishes, such as disposable pot pie dishes and rigid reusable trays or dishes, a variety of bag structures, such as french fry bags, hot dog bags and bags for cooking crusty filled products, for example, an apple turnover, a variety of box structures, such as pizza boxes, and domestic ware, such as reusable or disposable plates and dishes.

One of the significant advantages of the structure of the present invention is the ability to employ the structure in manufacturing, retailing and consumption of the foodstuff packaged therein. The packaging structure generally conforms to the physical three-dimensional form of the foodstuff, whether in the form of relatively stiff or rigid dish or tray, or in the form of a flexible bag structure, to enable the desired microwave heating of the foodstuff to be achieved.

It may be desirable to provide a layer of release material on food-contacting surfaces of the structure, to inhibit sticking of food to such surfaces.

SUMMARY OF DISCLOSURE

In summary of this disclosure, the present invention provides a novel form of a microwave heating element, useful for incorporation into a plurality of packaging structures for use in the cooking of food products by microwave energy and which comprises a plurality of nested elements of regular geometric outline, when viewed in plan, in the form of an I- or H- outline, or an array of elongate strips, and each formed of electroconductive material having a thickness which normally is opaque to the passage of microwave energy, supported as a substrate. Modifications are possible within the scope of this invention.

What I claim is:

1. A multiple layer article of manufacture, adapted to be formed into a packaging structure in which a foodstuff may be heated by microwave energy to a edible condition, comprising:

a plurality of individual discrete shapes of flexible electroconductive material supported in an array on a substrate layer, each said individual discrete shapes of flexible electroconductive material having a thickness which is normally opaque to microwave radiation and being formed in an H- or I- outline or elongate-strip shape, said individual discrete shapes being arranged on said substrate to define a space surrounding the periphery of each individual shape with the spaces surrounding the plurality of shapes defining a continuous aperture extending throughout the array of discrete shape and effective to generate thermal energy in said continuous aperture when said article is exposed to microwave energy and the foodstuff is in contact with or proximate to the aperture, said substrate layer being formed of microwave energy transparent material and being in adhered structural relationship with said plurality of individual discrete shapes of flexible electroconductive material so that a packaging structure may be formed from said article in which said foodstuff may be positioned.

2. The structure of claim 1 wherein said individual discrete shape of flexible electroconductive material have an H- or I- outline and are interfitted in said array.

3. The structure of claim 2 wherein each of the individual discrete shapes has the same dimensions and are arranged in a uniform array.

4. The structure of claim 3 wherein each of the individual discrete shapes has a pair of arms and at element joining the arms, each individually dimensioned for about 1/64 to about 7 inches.

5. The structure of claim 1 wherein each individual discrete shape of flexible electroconductive material is an elongate strip and are arranged in a uniform array.

6. The structure of claim 5 wherein each strip has a longitudinal dimension and a lateral dimension individually from about 1/64 to about 7 inches and each said strip is laterally and longitudinally spaced apart from each adjacent strip by about 1/64 to about 7 inches.

7. The article of claim 1 wherein said flexible electroconductive material has a thickness of at least about 1 micron.

8. The article of claim 1 wherein electroconductive material is aluminum foil having a thickness of from about 1 to about 15 microns.

9. The article of claim 8 wherein said aluminum foil has a thickness of about 3 to about 10 microns.

10. The article of claim 8 wherein said substrate layer is formed of microwave transparent structural stock material.

11. The article of claim 10 wherein said structural stock material is paper or paperboard.

12. The article of claim 11 wherein said stock material is provided on one side of the layer of electroconductive material and a polymeric film is provided on the other.

13. The article of claim 11 wherein said structural stock material is provided on both sides of the layer of electroconductive material.

14. The article of claim 1 wherein said electroconductive material is laminated between outer layers of polymeric material.

15. The article of claim 14 wherein at least one of said polymeric material layers is formed of rigid moldable material.

16. The article of claim 1 wherein a layer of electroconductive material having a thickness sufficient small as to effect conversion of a portion of incident microwave energy to thermal energy is positioned in engagement with said substrate layer to achieve an augmented heating effect from said array by exposure of said layer of electroconductive material to microwave energy.

17. The article of claim 1 wherein said microwave transparent layer comprises a polymeric film layer to which said electroconductive material is adhered by laminating adhesive.

18. The article of claim 17 wherein said continuous aperture is formed by selective demetallization.

19. The article of claim 18 wherein said electroconductive material is coated with a layer of detackifying material for said laminating adhesive following said selective demetallization.

20. The article of claim 18 wherein a layer of food release material is provided on food-contacting areas of said polymeric film layer on the opposite side thereof from that to which said electroconductive material is adhered.

* * * * *